United States Patent [19]

Jansz

[11] 4,129,009

[45] Dec. 12, 1978

[54] ANCHORING CONSTRUCTION ON THE SEA BOTTOM

[75] Inventor: Joost W. Jansz, The Hague, Netherlands

[73] Assignee: Hollandsche Beton Groep N.V., Rijswijk, Netherlands

[21] Appl. No.: 811,360

[22] Filed: Jun. 29, 1977

[30] Foreign Application Priority Data

Jun. 29, 1976 [NL] Netherlands ..... 7607130

[51] Int. Cl.[2] ..... E02B 17/00

[52] U.S. Cl. ..... 405/227

[58] Field of Search ..... 61/98, 94, 99, 100, 61/87, 88, 89, 90

[56] References Cited

U.S. PATENT DOCUMENTS

| | | | |
|---|---|---|---|
| 2,326,353 | 10/1943 | Gross | 61/94 |
| 2,688,848 | 9/1954 | Moon | 61/98 |
| 2,919,552 | 1/1960 | Hayward | 61/99 |
| 2,960,832 | 11/1960 | Hayward | 61/94 |
| 3,399,646 | 9/1968 | Vincent | 61/98 X |
| 3,550,385 | 12/1970 | Lowd et al. | 61/98 |
| 3,777,688 | 12/1973 | Melhose | 61/98 X |
| 3,780,685 | 12/1973 | Horton | 61/94 X |
| 3,999,395 | 12/1976 | Broms et al. | 61/99 |

*Primary Examiner*—Dennis L. Taylor

*Attorney, Agent, or Firm*—Sughrue, Rothwell, Mion, Zinn and Macpeak

[57] ABSTRACT

An anchoring arrangement including a concrete block 3 provided with countersunk end openings 4, 5 through which piles 6, 7 having limiting abutments 8, 9 are driven into the sea bottom. The block(s) may be supported on a base frame 1. If a floating load tethered by cables 10 raises the block it will successively engage each abutment to thereby evenly distribute the lifting forces.

4 Claims, 4 Drawing Figures

ANCHORING CONSTRUCTION ON THE SEA BOTTOM

BACKGROUND OF THE INVENTION

This invention relates to an anchoring construction on the sea bottom including a heavy block with at least one chain or cable connected to it, said block having at least one opening through which a pile is driven into the ground.

Such known anchoring constructions usually consist of a heavy block of concrete which is lowered to the sea bottom and remains in place due to its own weight. The block has to be heavy to be able to withstand the reaction forces working on it which try to lift and remove it. One or more piles are also driven into the sea bed and fastened to the block by applying grout between the pile and the edge of an opening in the block. This known anchorage construction is not reliable because the grout connection is not sufficiently strong. The grout connection failure(s) also result in the forces to which the block is subjected not being equally distributed over the piles present.

SUMMARY OF THE INVENTION

The object of the invention is to provide an anchoring construction which has a lower weight and yet can withstand higher forces which are equally divided over the piles.

According to the invention this object is attained because the pile or piles are provided with an abutment or head situated above the block, the transverse dimensions of which are larger than those of the opening, each pile having clearance in respect of its opening in the block. Accordingly, the block is held in place against horizontal movement by the pile or piles, at the same time being movable in a vertical direction but only until it reaches the abutment or head of the pile or piles. Preferably the block is provided with two or three openings through which piles are driven into the sea bottom. It is of no importance whether the abutments or heads are situated at the same level. When the forces exerted through the cables become so high that the block is lifted then it strikes the abutments of the various piles successively, whereby an equal dividing of the load takes place. Because the blocks cooperate with piles provided with abutments limiting the upwardly directed movements of the blocks, the blocks may have a lower weight because the vertical component of the anchoring force determined by the weight of the blocks is increased by the pull-out resistance of the piles, which can be adapted to the circumstances which may occur by choosing appropriate pile lengths.

Undersirable grout connections are thus not necessary.

Preferably the block rests on a base frame with passage openings which form guide channels for the piles. This base frame supports the piles against tilting, for which it may have a suitable height. The blocks may have a temporary connection to the frame.

It is particularly efficient to lower a very large base frame which carries a plurality of blocks, such as a frame which is right-angled in plan view and which is provided with blocks resting on its corners and to which anchor cables are connected. This provides a proper positioning of the anchoring points in respect of each other.

BRIEF DESCRIPTION OF THE DRAWING

In the drawings:

FIGS. 3 and 4 show side and plan views of a second embodiment.

DETAILED DESCRIPTION OF THE PREFERRED EMBODIMENTS

Figure 1:
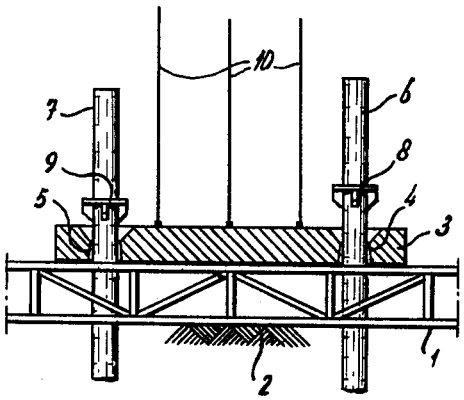
FIGS. 1 and 2 show side elevational views of a first embodiment of an anchoring construction according to the invention, in two positions.
Figure 2:
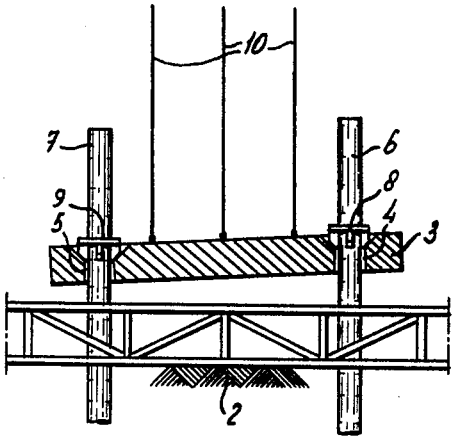

The construction shown in FIGS. 1 and 2 consists of a base frame 1 which is lowered to the sea bottom 2. On this frame a block 3 rests having openings 4 and 5 through which piles 6 and 7 are driven into the sea bottom and are provided with abutments 8 and 9. The openings 4 and 5 are widened at the upper side of the block 3 such that they can accomodate the abutments 8 and 9 in various angled positions. This is shown in FIG. 2 in which the block 3 is in a position in which it is drawn upwardly against the abutments 8 and 9 by the anchor cables 10.

Figure 3:
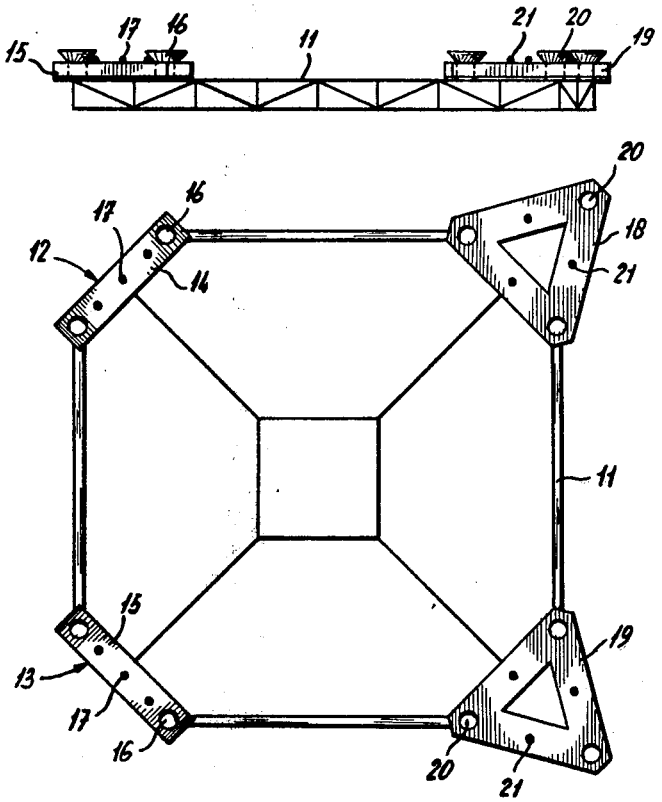

FIGS. 3 and 4 show a rectangular frame 11 where corners are configured in such a way that two of them support blocks 14 and 15 provided with openings 16 for piles and connecting points 17 for anchor cables. At the other corners triangular blocks 18 and 19 are shown providing a place for three piles through openings 20 with connections 21 for the cables.

Such a frame can be constructed in such a way that it can be floated to its destination and there lowered to the sea bottom, after which the piles are driven into the sea bottom through the openings provided for them and with the abutments above the blocks as indicated in FIGS. 1 and 2. The base frame then maintains the anchorages in the right position with respect to each other.

I claim:

1. An anchoring assembly, comprising:

(a) A heavy elongated block member of concrete or the like having substantial negative buoyancy, (b) at least two spaced vertical holes respectively extending through the block member proximate the opposite ends thereof, (c) at least two elongated piles each extending through one of the holes in the block member and adapted to be vertically driven into the sea bottom, (d) the diameter of each hole being greater than that of its associated pile whereby the block member may be raised vertically on the driven piles, (e) at least two abutment means individually secured to each driven pile at a distance above the block member and having transverse dimensions larger than the diameter of the associated block member hole to thereby limit the vertical raising of the block member on each pile, and (f) anchor cable means connected to the block member at a position spaced from and between the holes therein and adapted to be coupled to a buoyant load.

2. An anchoring assembly as defined in claim 1 further comprising a base frame disposed between the sea bottom and the block member and having vertical openings therein to accommodate the through passage of the piles.

3. An anchoring assembly as defined in claim 2, wherein the base frame supports a plurality of block member and pile assemblies mutually spaced from each other.

4. An anchoring assembly as defined in claim 1, wherein the upper end of the hole is countersunk.

* * * * *